US009401554B2

(12) United States Patent
Takane

(10) Patent No.: US 9,401,554 B2
(45) Date of Patent: Jul. 26, 2016

(54) CONNECTOR

(71) Applicant: IRISO ELECTRONICS CO., LTD., Kanagawa (JP)

(72) Inventor: Toru Takane, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 14/922,263

(22) Filed: Oct. 26, 2015

(65) Prior Publication Data

US 2016/0126649 A1 May 5, 2016

(30) Foreign Application Priority Data

Oct. 30, 2014 (JP) ..... 2014-220989

(51) Int. Cl.
*H01R 12/77* (2011.01)
*H01R 13/42* (2006.01)
*H01R 12/79* (2011.01)

(52) U.S. Cl.
CPC ..... *H01R 12/771* (2013.01); *H01R 13/42* (2013.01); *H01R 12/79* (2013.01)

(58) Field of Classification Search
CPC ..... H01R 12/79
USPC ..... 439/495
See application file for complete search history.

(56) References Cited

U.S. PATENT DOCUMENTS 6,773,287 B2 * 8/2004 Takashita ..... H01R 12/85 439/260
7,094,093 B2 * 8/2006 Nakano ..... H01R 12/771 439/495
7,255,584 B2 * 8/2007 Takashita ..... H01R 13/629 439/260
7,422,472 B2 * 9/2008 Hashiguchi ..... H01R 12/88 439/260
7,507,112 B2 * 3/2009 Mundt ..... H01R 13/193 439/357
7,540,764 B2 * 6/2009 Suzuki ..... H01R 12/79 439/260

(Continued)

FOREIGN PATENT DOCUMENTS

JP 2006-196424 A 7/2006
JP 2008-153059 A 7/2008

(Continued)

OTHER PUBLICATIONS

Notice of Reasons for Rejection from Japanese Patent App. No. 2014-220989 (May 19, 2015) with English language translation thereof.

*Primary Examiner* — Ross Gushi
(74) *Attorney, Agent, or Firm* — Cermak Nakajima & McGowan LLP; Tomoko Nakajima

(57) ABSTRACT

A connector includes a terminal, a housing configured to hold the terminal and having an insertion port for a flat conductor and a fitting chamber where the flat conductor and the terminal are in conductive contact, and an engaging projection with which the flat conductor engages in a removing direction inside the fitting chamber. The flat conductor includes an engaging recess provided in a side edge portion along an inserting direction in the fitting chamber and having an engaging edge portion configured to abut on and engage with the engaging projection in the removing direction, and a projecting piece part located between the engaging edge portion and a distal end part of the flat conductor. The fitting chamber has an escape space. When the flat conductor is removed, the projecting piece part abuts on the engaging projection, and is displaced in the inserting direction to enter the escape space.

4 Claims, 12 Drawing Sheets

(56) References Cited

U.S. PATENT DOCUMENTS 7,695,311 B2 * 4/2010 Nemoto ..... H01R 12/79 439/495
7,766,680 B2 * 8/2010 Suzuki ..... H01R 12/79 439/260
7,833,046 B2 * 11/2010 Tamura ..... H01R 12/774 439/329
7,850,473 B1 * 12/2010 Ozeki ..... H01R 23/661 439/260
7,955,107 B1 * 6/2011 Pao ..... H01R 12/88 439/260
8,002,567 B2 * 8/2011 Hara ..... H01R 12/79 439/329
8,123,550 B2 * 2/2012 Hoshino ..... H01R 13/641 439/260
8,192,219 B2 * 6/2012 Satoh ..... H01R 12/79 439/328
8,202,108 B2 * 6/2012 Shen ..... H01R 23/661 439/329
8,337,230 B1 * 12/2012 Kurachi ..... H01R 12/79 439/328
8,342,869 B2 * 1/2013 Okamura ..... H01R 24/00 439/260
8,398,417 B2 * 3/2013 Ozeki ..... H01R 12/774 439/260
8,579,654 B2 * 11/2013 Chen ..... H01R 12/61 439/267
8,608,509 B2 * 12/2013 Shimada ..... H01R 12/774 439/607.01
8,616,906 B2 * 12/2013 Iijima ..... H01R 12/88 439/260
8,678,844 B2 * 3/2014 Yoshisuji ..... H01R 12/592 439/260
8,851,918 B2 * 10/2014 Yoshisuji ..... H01R 13/639 439/260
8,936,476 B2 * 1/2015 Shindo ..... H01R 12/774 439/153
8,939,790 B2 * 1/2015 Jung ..... H01R 13/62 439/483
8,968,020 B2 * 3/2015 Nishiyama ..... H01R 13/627 439/345
9,054,451 B2 * 6/2015 Tateishi ..... H01R 12/774
9,065,210 B2 * 6/2015 Narita ..... H01R 13/629
9,088,115 B2 * 7/2015 Komoto ..... H01R 12/774
9,263,812 B2 * 2/2016 Ishimaru ..... H01R 12/774
2005/0075004 A1 * 4/2005 Endou ..... H01R 12/79 439/495
2007/0077809 A1 * 4/2007 Takashita ..... H01R 13/629 439/492
2008/0050958 A1 * 2/2008 Hashiguchi ..... H01R 12/79 439/312
2009/0068860 A1 * 3/2009 Suzuki ..... H01R 12/88 439/67
2010/0261375 A1 * 10/2010 Wang ..... H01R 12/88 439/492
2012/0083150 A1 * 4/2012 Ozeki ..... H01R 12/79 439/345
2012/0220171 A1 * 8/2012 Shimada ..... H01R 12/774 439/660
2012/0238125 A1 * 9/2012 Yoshisuji ..... H01R 12/592 439/350
2013/0309887 A1 * 11/2013 Honda ..... H01R 13/193 439/260
2013/0309891 A1 * 11/2013 Tateishi ..... H01R 12/774 439/310
2014/0045383 A1 * 2/2014 Fujii ..... H01R 12/79 439/630
2014/0057478 A1 * 2/2014 Yoshisuji ..... H01R 13/639 439/350
2015/0244092 A1 * 8/2015 Ashibu ..... H01R 12/774 439/372
2015/0270632 A1 * 9/2015 Takane ..... H01R 12/716 439/78

FOREIGN PATENT DOCUMENTS

JP 2011-222141 A 11/2011
JP 2012-119234 A 6/2012
JP 2013-069412 A 4/2013
JP 2014-179300 A 9/2014

* cited by examiner

CONNECTOR

BACKGROUND OF THE INVENTION

1. Field of the Invention

The present invention relates to a connector that conductively connects a flat conductor and a circuit board.

2. Description of the Related Art

Connectors conventionally used in electronic apparatuses are mounted on a circuit board to conductively connect the circuit board to, for example, a flexible printed circuit (FPC) or a flexible flat cable (FFC) (referred to as a "flat conductor" in the specification and the claims). These connectors are installed in a lot of electronic apparatuses because they can connect an apparatus inner unit, such as a computer or a liquid crystal display, to the circuit board.

As such a connector, for example, Japanese Unexamined Patent Application Publication No. 2011-222141 discloses a connector including a lock mechanism that fixes a flat conductor to the connector by engaging with engaging recesses provided in side edges of the flat conductor extending in the inserting direction of the flat conductor, that is, in the longitudinal direction of the flat conductor. To pull out the flat conductor from the connector, first, a lock part is operated to disengage from the engaging recesses of the flat conductor. Then, the flat conductor can be pulled out from the connector by being pulled in this state.

However, when pulling out the flat conductor from the connector having such a lock mechanism, the operator sometimes makes a mistake in the operation and pulls the flat conductor without releasing the lock or without sufficiently releasing the lock. In this case, in the above-described connector, projections are caught by projecting piece parts closer to the distal end than the engaging recesses. When further force is applied in this state, rupture may occur in root portions of the projecting piece parts. If the projecting piece parts are torn by the pulling force, they remain inside the connector and touch the flat conductor and terminals. This may cause connection failure.

SUMMARY OF THE INVENTION

The present invention has been made in the context of the above-described related art, and an object of the invention is to suppress rupture of a flat conductor even when a pulling force in a removing direction is applied to the flat conductor in a lock state in a connector including a lock mechanism that fixes the flat conductor to the connector.

To achieve the above object, the present invention has the following features.

A connector according to an aspect of the present invention includes a flat conductor, a terminal in conductive contact with the flat conductor, a housing configured to hold the terminal and having an insertion port for the flat conductor and a fitting chamber where the flat conductor and the terminal are in conductive contact with each other, and a lock part with which the flat conductor engages in a removing direction inside the fitting chamber. The flat conductor includes an engaging recess provided in a side edge portion along an inserting direction into the fitting chamber and having an engaging edge portion configured to abut on and engage with the lock part in the removing direction, and a projecting piece part located between the engaging edge portion and a distal end part of the flat conductor. The fitting chamber has, at a position opposed to a distal end of the projecting piece part, an escape space configured to receive the projecting piece part that abuts on the lock part and is deformed in the inserting direction by pulling the flat conductor in the removing direction.

When the flat conductor is strongly pulled in a state in which the engaging edge portion of the projecting piece part is engaged with the lock part, a body part of the flat conductor except for the projecting piece part is pulled in the removing direction, whereas the projecting piece part is caught by the lock part and is left between the lock part and an inner wall. In this case, reactive force to force of contact and engagement of the engaging edge portion with the lock part is concentrated and applied to a root of the projecting piece part by the pull in the removing direction. In particular, in the connector of the related art, the inner wall of the fitting chamber is provided at a position abutting on the distal end part of the flat conductor in a fitted state. In this case, if the flat conductor is strongly pulled in a state in which the engaging edge portion is engaged with the lock part, since there is no space around the projecting piece part, the projecting piece part cannot move and deform to avoid engagement of the lock part. For this reason, the projecting piece part cannot come out from between the lock part and the inner wall of the fitting chamber. Hence, excessive force is sometimes applied to the root of the projecting piece part, and this causes rupture of the projecting piece. As a result, only the body part of the flat conductor except for the projecting piece part is pulled out of the fitting chamber, and the projecting piece part is left inside the fitting chamber.

In contrast, the fitting chamber according to the aspect of the present invention has, at the position opposed to the distal end of the projecting piece part, the escape space that receives the projecting piece part abutting on the lock part and deformed in the inserting direction by pulling the flat conductor in the removing direction. In this case, when the flat conductor is strongly pulled in the removing direction in the lock state, as described above, the projecting piece part can deform in the inserting direction. This is because the fitting chamber has the escape space that can receive the deformed projecting piece part. Specifically, when the engaging edge portion abuts on the lock part, the projecting piece part attempts to stay at the position closer to the back side of the fitting chamber than the lock part. When the body part of the flat conductor is further pulled in the removing direction in this state, load is applied from the lock part to the projecting piece part. As a result, the projecting piece part deforms so that the distal end thereof is directed in the inserting direction in a state in which the projecting piece part is connected at the root to the body part. Then, the deformed projecting piece part can enter the escape space. In this way, the projecting piece part can be deformed by the load from the lock part so that it turns from the root. Such deformation allows the projecting piece part to move in the removing direction along with the body part of the flat conductor while deforming to avoid engagement of the lock part. Thus, excessive load is unlikely to be applied to the root of the projecting piece part, and this suppresses rupture. Also, the flat conductor can be removed from the connector without causing rupture.

A connector according to another aspect of the present invention is conductively connected to a flat conductor serving as a connecting object, and includes a terminal in conductive contact with the flat conductor, a housing configured to hold the terminal and having an insertion port for the flat conductor and a fitting chamber where the flat conductor and the terminal are in conductive contact with each other, and a lock part with which the flat conductor engages in a removing direction inside the fitting chamber. The flat conductor includes an engaging recess provided in a side edge portion along an inserting direction into the fitting chamber and having an engaging edge portion configured to abut on and engage with the lock part in the removing direction, and a projecting piece part located between the engaging edge portion and a distal end part of the flat conductor. The housing has an escape space configured to receive the projecting piece part that abuts on the lock part and is deformed in the inserting direction when the flat conductor is removed.

According to the present invention, the connector can be provided with the operation and effect of the present invention by fitting the flat conductor in the connector.

A length of the escape space in a widthwise direction of the flat conductor in a fitted state may be more than a length of the projecting piece part in the widthwise direction. This reduces a portion of the distal end part of the flat conductor in contact with an inner wall of the fitting chamber on the side of the root of the projecting piece part. Hence, it is possible to reduce a portion of the projecting piece part that is restricted by the inner wall from deforming and to easily deform the projecting piece part. Further, since the escape space can be made wide, the deformed projecting piece part is allowed to escape more. Thus, it is possible to further suppress rupture at the root of the projecting piece part.

According to the present invention, it is possible to provide the connector that has the lock part for fixing the flat conductor to the connector and that suppresses rupture of the flat conductor even when a pulling force in the removing direction is applied to the flat conductor in a state in which the lock part is engaged with the flat conductor.

BRIEF DESCRIPTION OF THE DRAWINGS

FIG. 11A is a cross-sectional view taken along the plate thickness direction of the flat conductor, and FIG. 11B is a cross-sectional view taken along the plate surface direction of the flat conductor.

FIG. 13A is a cross-sectional view taken along the plate thickness direction of the flat conductor, and FIG. 13B is a cross-sectional view taken along the plate surface direction of the flat conductor.

DESCRIPTION OF THE PREFERRED EMBODIMENTS

Figure 1:
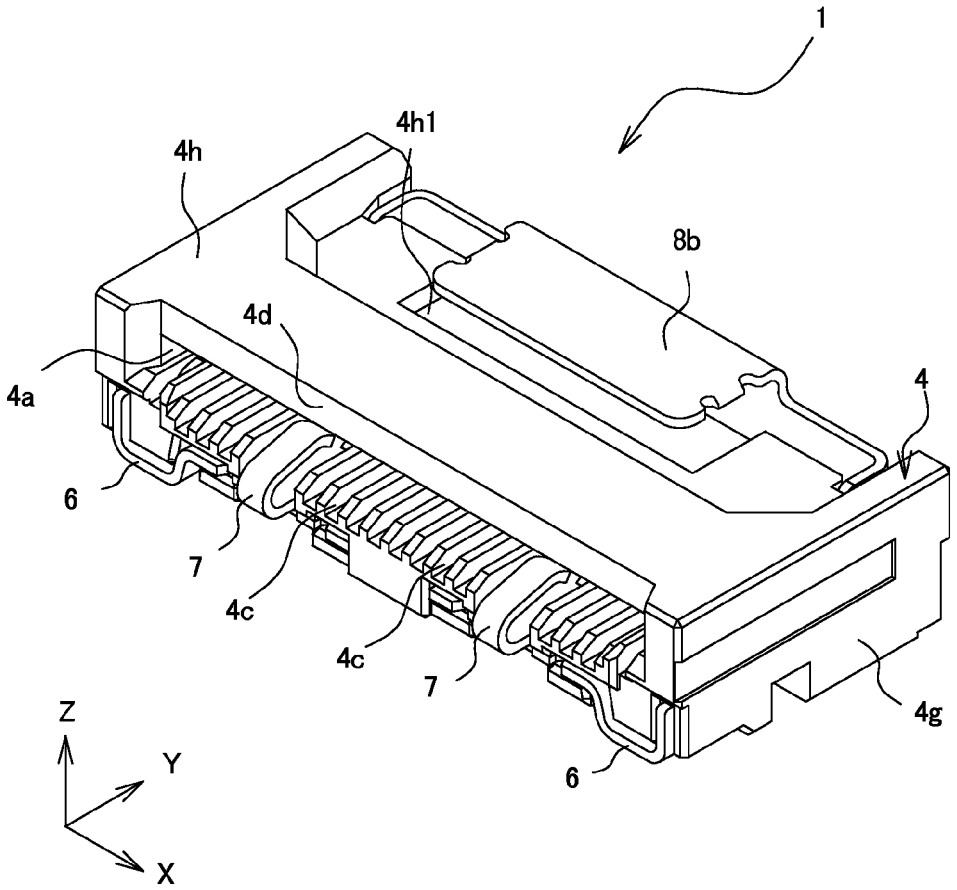
FIG. 1 is an external perspective view of a connector according to an embodiment.
Figure 2:
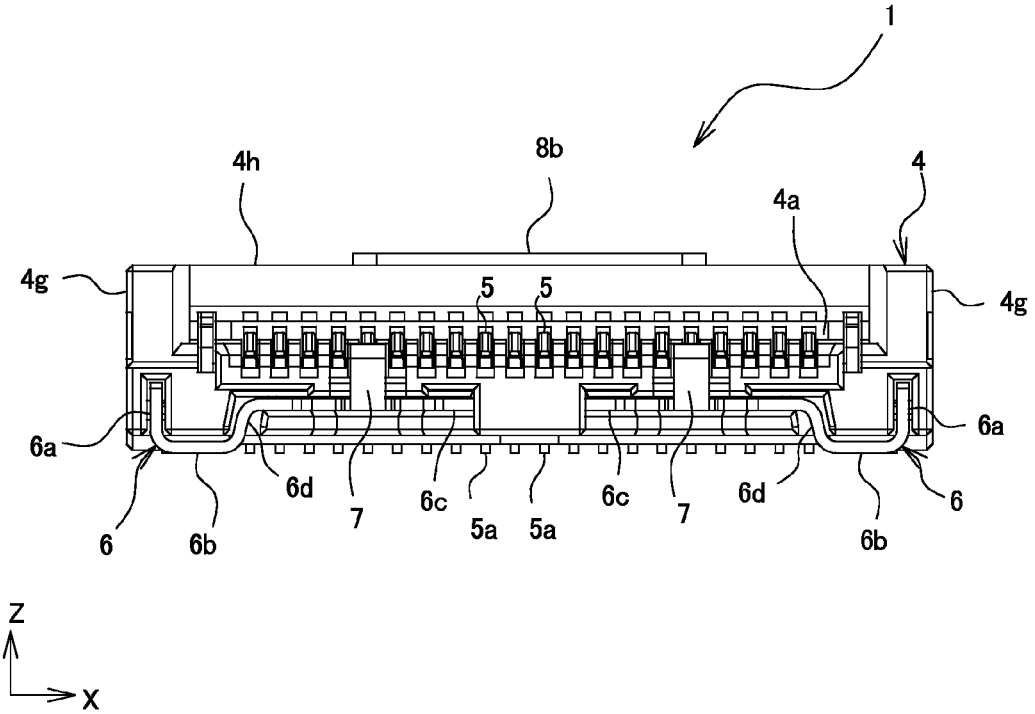
FIG. 2 is a front view of the connector of FIG. 1.
Figure 3:
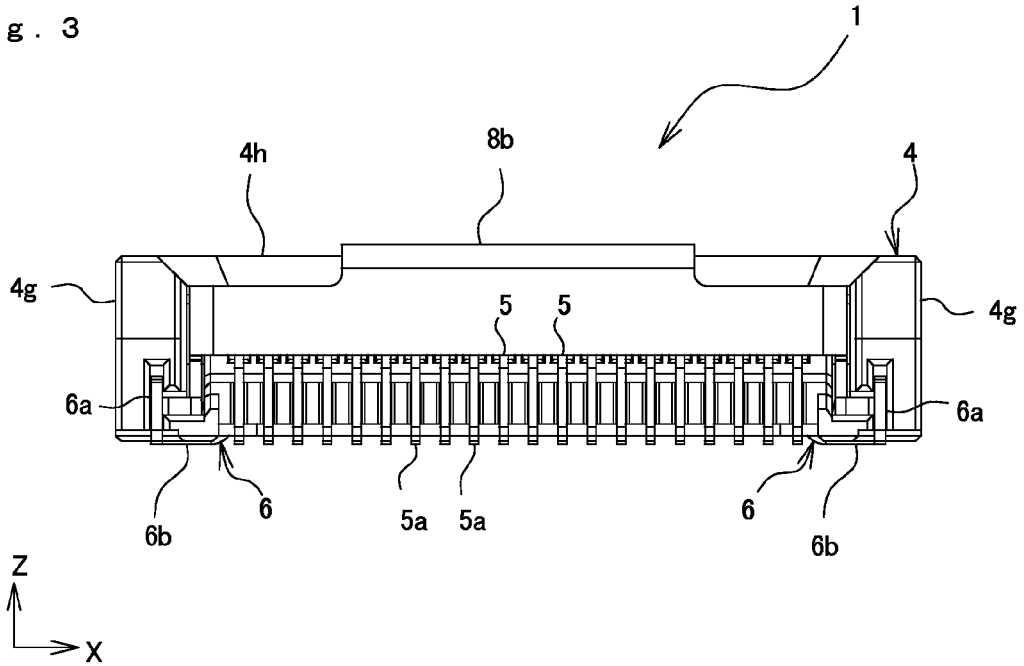
FIG. 3 is a rear view of the connector of FIG. 1.
Figure 4:
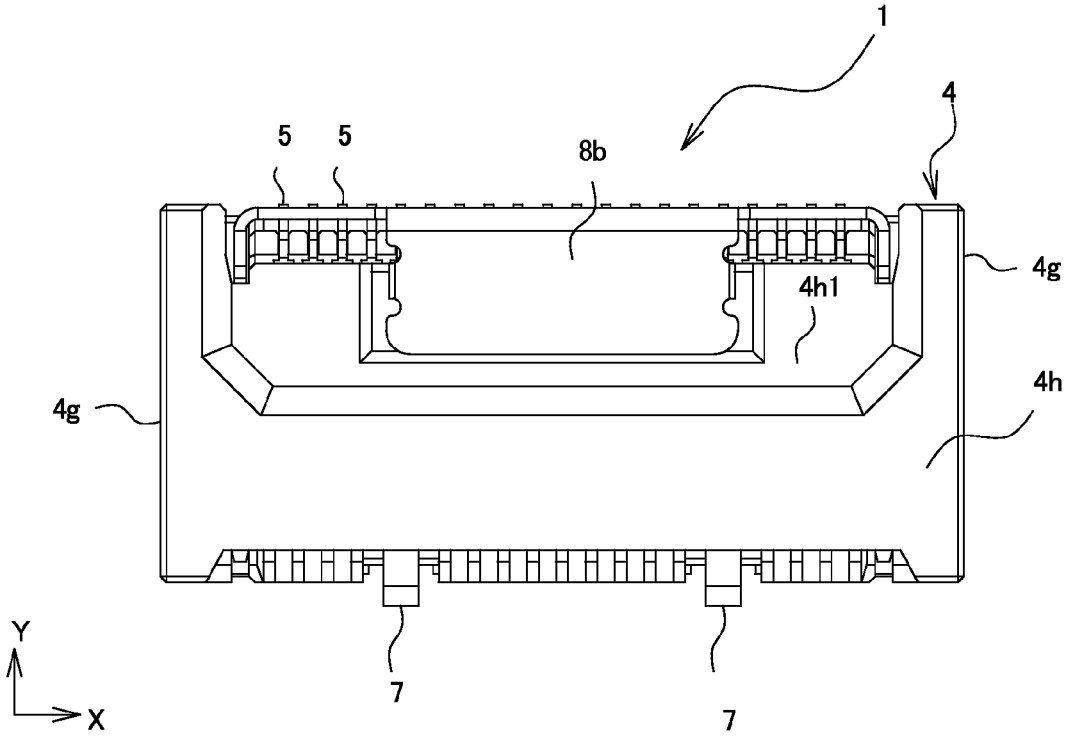
FIG. 4 is a plan view of the connector of FIG. 1.
Figure 5:
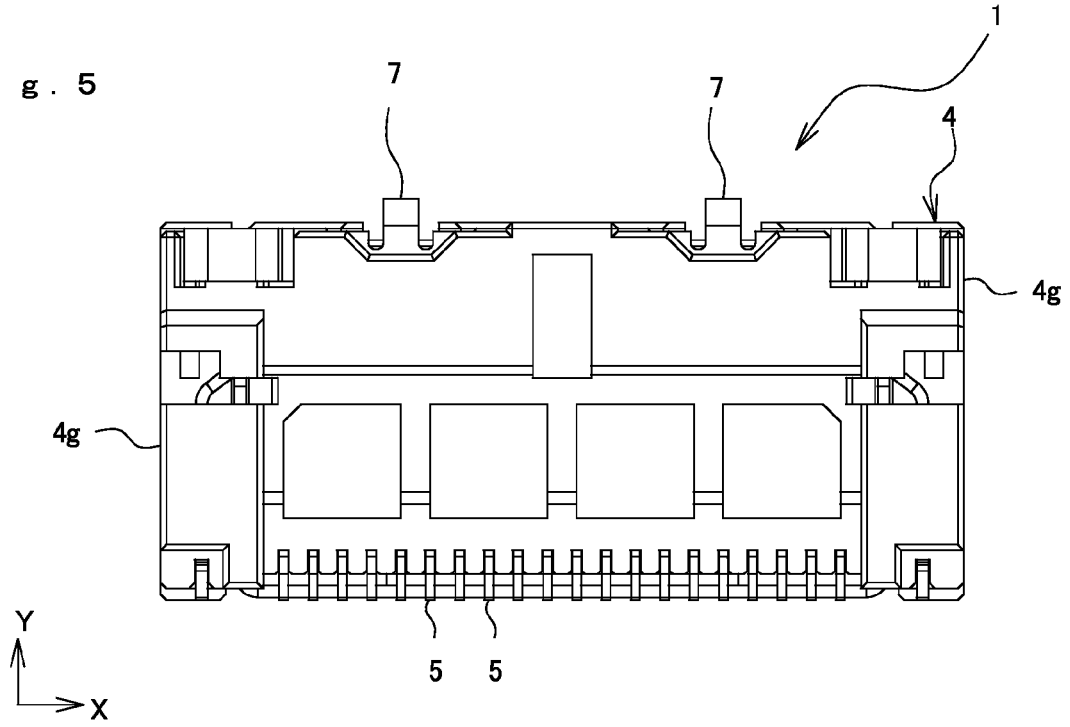
FIG. 5 is a bottom view of the connector of FIG. 1.
Figure 6:
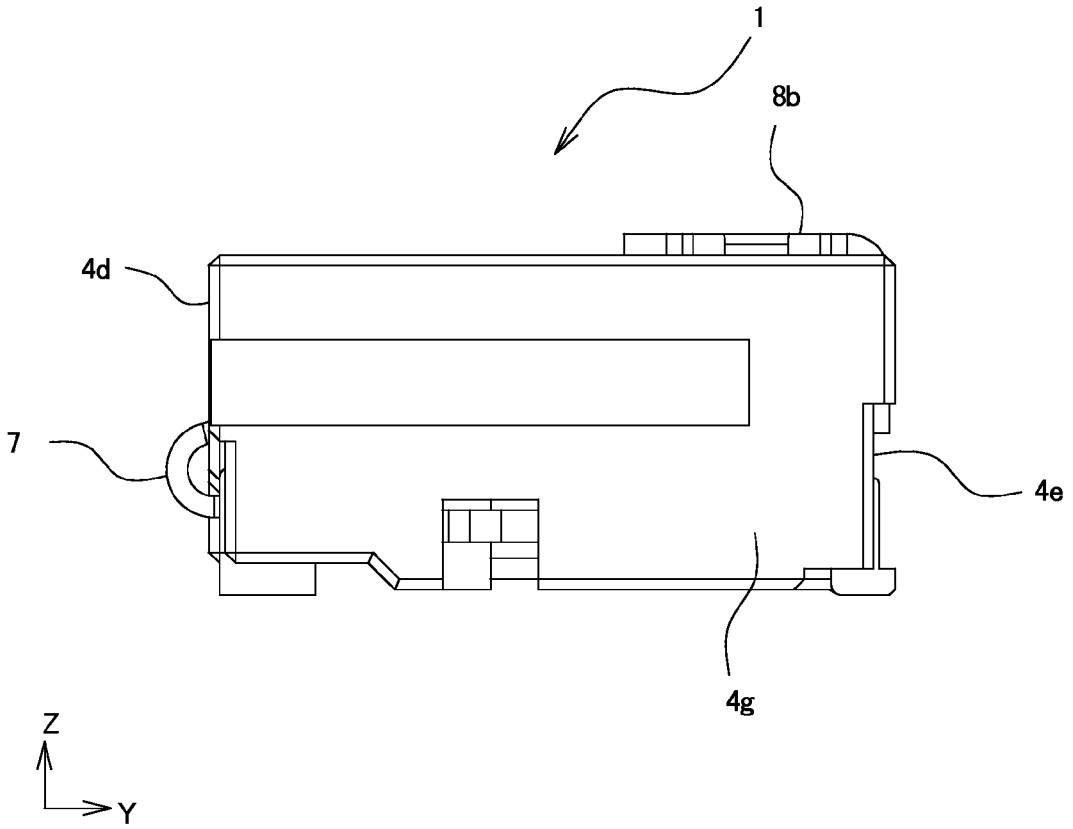
FIG. 6 is a right side view of the connector of FIG. 1.

A connector according to a preferred embodiment of the present invention will be described below with reference to the drawings. In the following embodiment, a connector 1 is mounted on a circuit board 2 to conductively connect a flat conductor 3, such as an FPC or an FFC, to a circuit of the circuit board 2.

In this specification, the widthwise direction (longer side direction) of the connector 1 is referred to as an X-direction, the front-rear direction (shorter side direction) is referred to as a Y-direction, and the height direction (up-down direction) of the connector 1 is referred to as a Z-direction. In the front-rear direction Y of the connector 1, the side where an insertion port 4*a* is provided is referred to as a "front side", and the opposite side is referred to as a "rear side." Further, the side of the circuit board 2 in the height direction Z is referred to as a "lower side", and the side of the connector 1 is referred to as an "upper side." However, these do not limit the mounting method and use method of the connector 1 on the circuit board 2.

Since the left side view is shown symmetrically with the right side view, a description thereof is skipped. Further, since two reinforcing members 6 provided in the connector 1 are symmetrically formed, an external perspective view of one of the reinforcing members 6 is omitted.

Embodiment

FIGS. 1 to 14

A connector 1 according to an embodiment is laid flat and fixed to a circuit board 2. By inserting a flat conductor 3 into the connector 1 in this state, the circuit board 2 and the flat conductor 3 are connected conductively.

The connector 1 is mounted on the circuit board 2, and conductively connects the flat conductor 3 and the circuit board 2. Further, as illustrated in FIGS. 1 to 14, the connector 1 includes a housing 4, terminals 5, reinforcing members 6, ground terminals 7, and an elastic lock piece 8.

First, the structure of the flat conductor 3 serving as a connecting object to be connected by the connector 1 of the embodiment will be described.

Flat Conductor

The flat conductor 3 includes projecting piece parts 3A and a body part 3B.

The projecting piece parts 3A are formed by insulating coating. The projecting piece parts 3A project in the widthwise direction X from a distal end of the body part 3B, and are located between engaging edge portions 3*c*1 and a distal end part 3C of the flat conductor 3 (to be described later). The projecting piece parts 3A are also disposed on both sides in the widthwise direction X of a conductive wire 3*a* exposed from insulating layers 3*b* (to be described later).

The body part 3B includes a conductive wire 3*a*, insulating layers 3*b*, engaging recesses 3*c*, and a ground connecting portion 3*d*.

Figure 10:
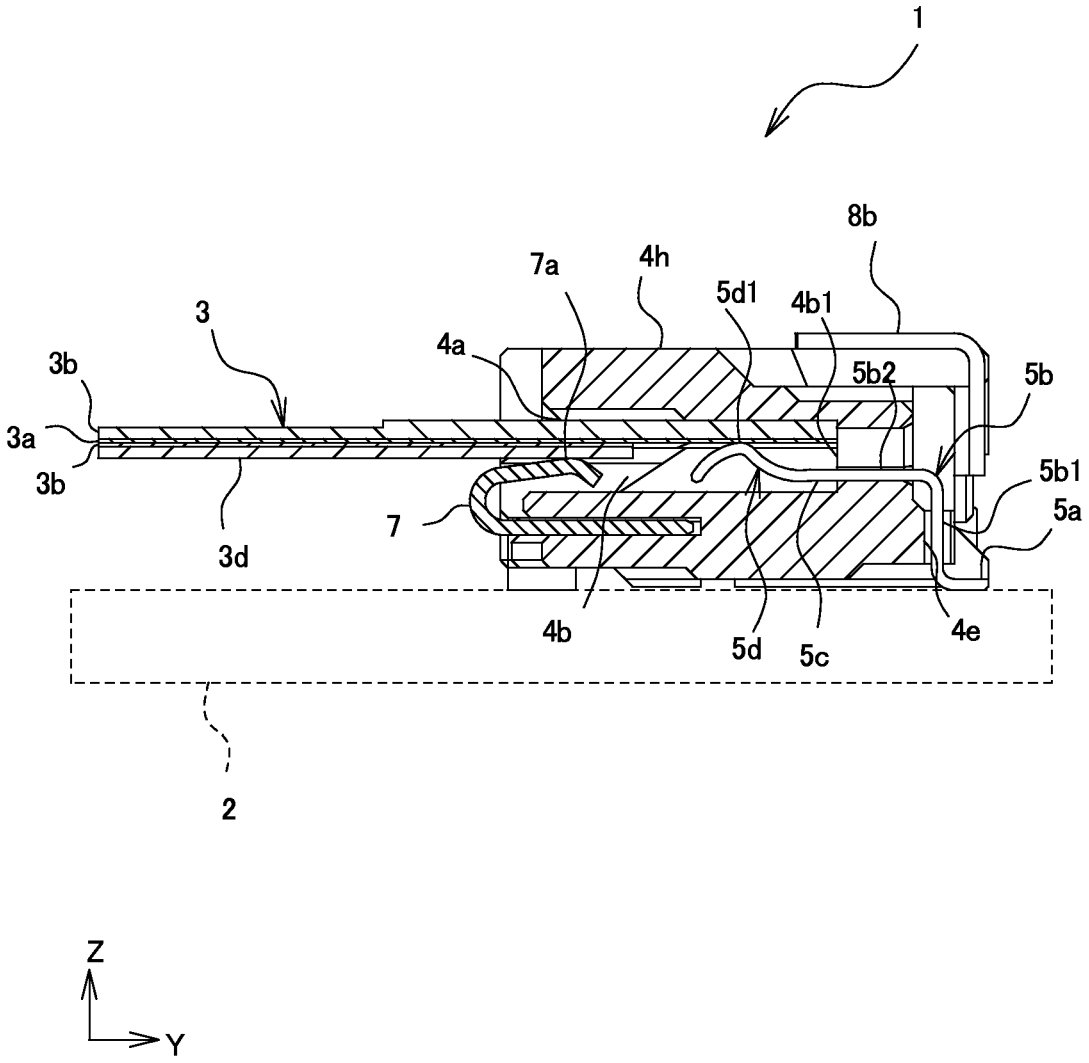
FIG. 10 is an explanatory cross-sectional view of the connector of FIG. 1 in which the flat conductor is fitted.

As illustrated in FIG. 10, both front and back surfaces of the conductive wire 3*a* are covered with the insulating layers 3*b*, and the conductive wire 3*a* is exposed outside from the insulating layers 3*b* at an insertion end (distal end) into the housing 4. In this exposed portion, the conductive wire 3*a* is in conductive contact with the terminals 5 of the connector 1.

The insulating layers 3*b* are formed by insulating coating, and are stacked on both front and back surfaces of the conductive wire 3*a*, as described above.

Figure 7:
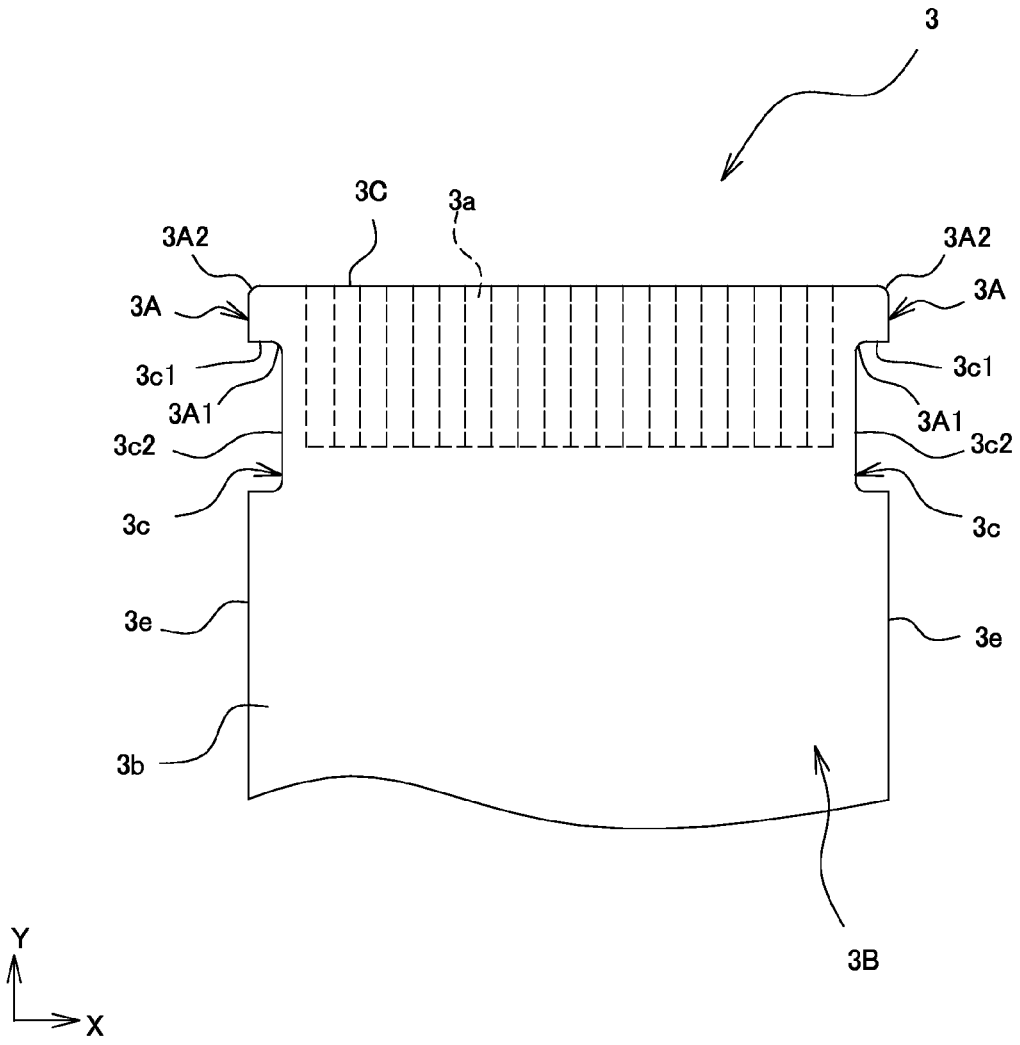
FIG. 7 illustrates a flat conductor to be in conductive contact with the connector of FIG. 1.

As illustrated in FIG. 7, the engaging recesses 3*c* are provided in corresponding side edge portions 3*e* that extend in the inserting direction of the flat conductor 3 on the side of the distal end part 3C. The engaging recesses 3*c* are formed as cutout portions by cutting out the side edges of the flat conductor 3 in the shape of a recess. The engaging recesses 3*c* include their respective engaging edge portions 3*c*1 and inner edge portions 3*c*2.

The engaging edge portions 3*c*1 are formed by plate edges extending in the widthwise direction X of the flat conductor 3, and engaging projections 8*a* of an elastic lock piece 8 (to be described later) are engaged with the engaging edge portions 3*c*1.

The inner edge portions 3*c*2 are formed by plate edges extending in the inserting direction of the flat conductor 3, and are provided on the inner sides of the engaging recesses 3*c*.

The configuration of the connector 1 of the embodiment will be described below.

Housing

The housing 4 is formed of insulating resin, and is shaped like a substantially rectangular parallelepiped, as illustrated in FIGS. 1 to 6. The housing 4 includes an insertion port 4*a* for the flat conductor 3, a fitting chamber 4*b*, and terminal receiving portions 4*c*.

The insertion port 4*a* is provided in a front side wall 4*d* at the front of the housing 4, and communicates with the fitting chamber 4*b*.

The fitting chamber 4*b* is provided inside the housing 4, and is surrounded by inner walls 4*b*1 extending in the front-rear direction Y and a back-side inner wall (hereinafter simply referred to as a back wall) 4*b*2 extending in the widthwise direction X. The fitting chamber 4*b* further includes escape spaces 4*f* on its rear side.

The escape spaces 4*f* are provided on the rear side of the distal end part 3C of the flat conductor 3 in a fitted state. The escape spaces 4*f* are also provided opposed to distal ends of the projecting piece parts 3A of the flat conductor 3 in the fitted state.

The escape spaces 4*f* are provided between first side wall portions 4*f*1 extended from the inner walls 4*b*1 along the front-rear direction Y of the fitting chamber 4*b*, and second side wall portions 4*f*2 opposed to the first side wall portions 4*f*1. The length of the escape spaces 4*f* in the height direction Z is substantially equal to the length of the flat conductor 3 in the plate thickness direction. By thus forming no extra space between the flat conductor 3 in the fitted state and the inner walls 4*b*1, the height of the connector 1 can be made low as a whole.

A plurality of terminal receiving portions 4*c* communicate with the fitting chamber 4*b*, and are arranged in parallel in the widthwise direction X of the housing 4 on a lower side of the fitting chamber 4*b*. The terminals 5 are received one by one in the corresponding terminal receiving portions 4*c*.

Terminals

The terminals 5 are formed by bending a conductive metal plate, and are arranged in parallel in the widthwise direction X of the housing 4 by being received one by one in the corresponding terminal receiving portions 4*c*. Further, as illustrated in FIG. 10, each terminal 5 includes a circuit-board connecting portion 5*a*, a fixed portion 5*b*, an elastic piece portion 5*c*, and a contact portion 5*d*.

The circuit-board connecting portion 5*a* is provided at one end of the terminal 5, and is soldered to the circuit board 2.

The fixed portion 5*b* has a vertical piece portion 5*b*1 and a horizontal piece portion 5*b*2.

The vertical piece portion 5*b*1 is provided along a rear side wall 4*e* of the housing 4, and is connected at a lower end to the circuit-board connecting portion 5*a*. The horizontal piece portion 5*b*2 penetrates the rear side wall 4*e* of the housing 4, and the terminal 5 is fixed to the housing 4 in that position. In the embodiment, the terminal 5 and the housing 4 are formed by insert integral molding.

The elastic piece portion 5*c* extends in the front-rear direction Y in a cantilevered manner from a distal end of the horizontal piece portion 5*b*2 of the fixed portion 5*b* toward the insertion port 4*a* of the housing 4. Further, the contact portion 5*d* is elastically supported at a distal end of the elastic piece portion 5*c*. The elastic piece portion 5*c* elastically deforms in the height direction Z of the connector 1 by using a portion connected to the horizontal piece portion 5*b*2 as a fulcrum inside the fitting chamber 4*b*.

The contact portion 5*d* is bent in a peak shape in a direction to contact with the flat conductor 3, and a contact part 5*d*1 is provided at almost the center of the contact portion 5*d* to be conductively connected to the flat conductor 3. The contact part 5*d*1 is in conductive contact with the flat conductor 3 inside the fitting chamber 4*b*.

Reinforcing Members

A pair of reinforcing members 6 are formed by a conductive metal plate, and are provided on the lower side of the housing 4, on the front side in the front-rear direction Y, and at corresponding ends of the housing 4 in the widthwise direction X, as illustrated in FIG. 1. The reinforcing members 6 are symmetrical with each other, and reinforce wall bodies 4*g* that form the fitting chamber 4*b*.

Each reinforcing member 6 includes a fixing portion 6*a* fixed to the housing 4, a ground connecting portion 6*b*, a reinforcing plate 6*c*, and a stepped portion 6*d*.

The fixing portion 6*a* has a plate surface along the height direction Z, and is press-fitted in a press-fitting hole (not illustrated) provided on the bottom side of the housing 4. The fixing portion 6*a* fixes the reinforcing member 6 to the housing 4.

The ground connecting portion 6*b* has a plate surface parallel to a bottom surface of the housing 4. Further, the ground connecting portion 6*b* is exposed outside from the housing 4 on the lower side of the housing 4, and is soldered to a ground connecting pad (not illustrated) provided in the circuit board 2.

The reinforcing plate 6*c* has a plate surface parallel to the bottom surface of the housing 4. Further, the reinforcing member 6 is inserted in the plate of a wall body 4*g* that forms a bottom wall of the housing 4, but is not exposed from the housing 4 toward the bottom side.

The stepped portion 6*d* is provided between the ground connecting portion 6*b* and the reinforcing plate 6*c*. While the ground connecting portion 6*b* is located on the lower side of the connector 1 and is exposed from the bottom surface, as described above, the reinforcing plate 6*c* is located at a position higher than the ground connecting portion 6*b*, and is stored inside the housing 4. These two portions having different heights are connected by the stepped portion 6*d*.

Ground Terminals

Figure 8:
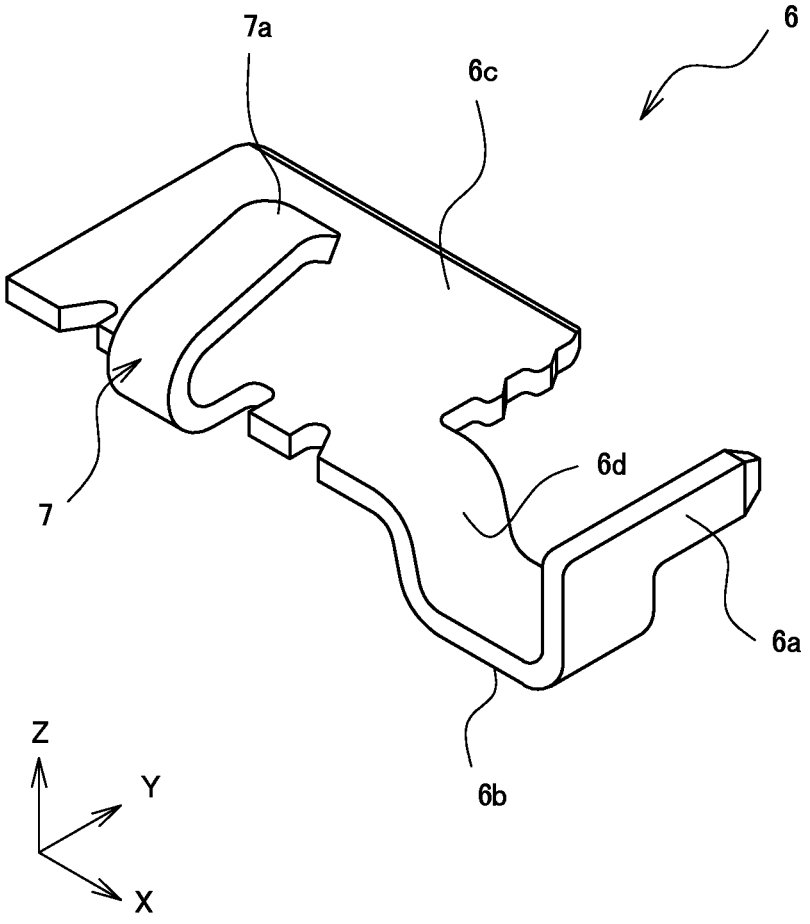
FIG. 8 is an external perspective view of a reinforcing member provided in the connector of FIG. 1.

Each ground terminal 7 is formed by a conductive metal piece, and is provided integrally with the reinforcing member 6. As illustrated in FIG. 8, the ground terminal 7 is provided at each end of the housing 4 in the widthwise direction X.

The ground terminal 7 is substantially U-shaped so that it extends in a cantilevered manner from the reinforcing member 6 toward the front side in the front-rear direction Y, is bent upward, and is bent back toward the rear side in the front-rear direction Y. A distal end of the ground terminal 7 is located inside the fitting chamber 4*b*, and has a bent portion 7*a*. The bent portion 7*a* is bent like a peak in a direction to contact with the flat conductor 3 in a fitted state and contacts with the ground connecting portion 3*d* of the flat conductor 3.

By thus forming the ground terminal 7 integrally with the reinforcing member 6, the ground terminal 7 and the reinforcing member 6 can be attached to the housing 4 by one operation. Hence, it is possible to enhance assembly efficiency and to make the number of components less than when the ground terminal 7 and the reinforcing member 6 are separately provided.

Elastic Lock Piece

Figure 9:
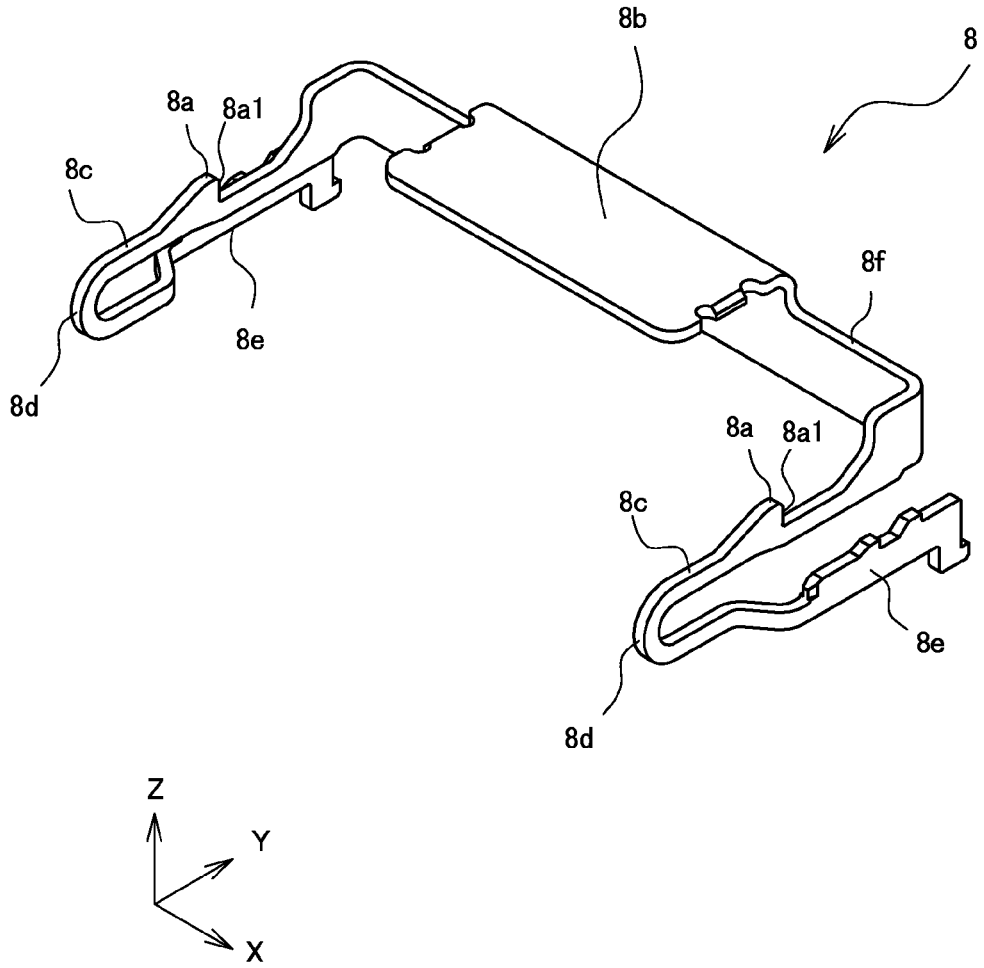
FIG. 9 is an external perspective view of an elastic lock piece provided in the connector of FIG. 1.

As illustrated in FIG. 9, the elastic lock piece 8 includes fixed portions 8*e*, curved portions 8*d*, elastic arms 8*c*, engaging projections 8*a* serving as a "lock part", extended portions 8*f*, and an operating portion 8*b*.

The fixed portions 8*e* extend frontward in the front-rear direction Y. Projections are provided on upper sides of the fixed portions 8*e*, and are fixed by being press-fitted in fixing grooves (not illustrated) provided in the fitting chamber 4*b* of the housing 4.

The curved portions 8*d* continue from the fixed portions 8*e*, and are substantially U-shaped to protrude frontward in the front-rear direction Y. Further, the curved portions 8*d* are provided closer to the center side in the widthwise direction X than the fixed portions 8*e*. While the fixed portions 8*e* are fixed inside the wall bodies 4*g* of the housing 4, the curved portions 8*d* are stored inside the fitting chamber 4*b*.

The elastic arms 8*c* are formed by plate-like pieces, and extend rearward in the front-rear direction Y from the curved portions 8*d*.

The engaging projections 8*a* are provided at almost the centers of the elastic arms 8*c* in the front-rear direction Y to project upward in a peak shape. The engaging projections 8*a* have their respective abutting edges 8*a*1 along the height direction Z. The plate width of the engaging projections 8*a* corresponds to about a half of the length of the engaging edge portions 3*c*1 in the plate width direction of the flat conductor 3. By thus making the length of the engaging edge portions 3*c*1 more than the plate width of the engaging projections 8*a*, the engaging projections 8*a* can be firmly engaged with the engaging edge portions 3*c*1. This can enhance the fall prevention effect.

By pushing the operating portion 8*b* (to be described later) downward, the curved portions 8*d* are elastically deformed, and the elastic arms 8*c* are also elastically deformed in the height direction Z. At this time, the engaging projections 8*a* are elastically displaced in the height direction Z along with the elastic deformation of the elastic arms 8*c*.

The extended portions 8*f* are shaped like a substantially rectangular flat plate to continue from rear end portions of the elastic arms 8*c* and to extend in the widthwise direction X. The extended portions 8*f* are also exposed outside on the rear side of the housing 4, and are disposed along the rear side wall 4*e*.

The operating portion 8*b* is shaped like a substantially rectangular flat plate to continue from the extended portions 8*f* and to extend in the widthwise direction X. The operating portion 8*b* is also provided along an upper surface of a top part 4*h* on the upper side of the housing 4 and above a recess 4*h*1 provided in the top part 4*h*.

Size Reduction of Connector

The elastic lock piece 8 is structured so that the elastic arms 8*c*, the engaging projections 8*a*, the curved portions 8*d*, and the fixed portions 8*e* are all stored inside the housing 4. Hence, exposure of the elastic lock piece 8 to the outside of the housing 4 is reduced, and this contributes to size reduction of the entire connector 1.

The ground connecting portion 6*b* of each reinforcing member 6 does not protrude outside from the housing 4 in the plate surface direction of the circuit board 2, but is provided inside the bottom surface of the housing 4. Hence, the connector 1 can be made more compact and the occupation area thereof on the circuit board 2 can be reduced.

A bottom side of the ground connecting portion 6*b* functions as a portion to be soldered to the circuit board 2, where the connector 1 is fixed to the circuit board 2. The fixing portion 6*a* is located on the bottom side of the housing 4, but does not protrude outside from the housing 4. Hence, the connector 1 can also be made more compact in this regard.

The operating portion 8*b* is disposed on the upper side of the recess 4*h*1 of the top part 4*h*. To remove the flat conductor 3 from the connector 1, the operating portion 8*b* is pushed down toward the housing 4. At this time, the operating portion 8*b* is displaced to enter the recess 4*h*1 of the housing 4. Hence, the operating portion 8*b* can be sufficiently pushed toward the housing 4 without interfering with the housing 4. Further, since the operating portion 8*b* is thus disposed on the upper side of the recess 4*h*1, there is no need to protrude the operating portion 8*b* upward from the top part 4*h* of the housing 4 by the amount of displacement in the height direction Z. This can reduce the height of the connector 1.

Description of Method for Fitting Flat Conductor

Next, the method for using the connector 1 will be described.

First, as illustrated in FIG. 10, the flat conductor 3 is inserted from the insertion port 4*a* into the fitting chamber 4*b*. The distal end part 3C of the flat conductor 3 comes into contact with the engaging projections 8*a* of the elastic lock piece 8, pushes the engaging projections 8*a* down toward the circuit board 2, and then goes over the engaging projections 8*a*. At this time, the engaging projections 8*a* elastically deform to tilt. In the meantime, restoring force acts on the elastic lock piece 8 so that the engaging projections 8*a* return toward the top part 4*h*. For this reason, the flat conductor 3 is pressed toward the top part 4*h* by the engaging projections 8*a*. In this state, the flat conductor 3 is inserted along the lower surface of the top part 4*h* of the fitting chamber 4*b* into the fitting chamber 4*b* of the connector 1.

Although the housing 4 is pressed at this time by the flat conductor 3 that is pressed by the engaging projections 8*a*, since the reinforcing plates 6*c* are inserted in the plates of the wall bodies 4*g* of the housing 4, rigidity of the housing 4 is increased. Hence, even when the wall bodies 4*g* receive load from the flat conductor 3 inserted in the fitting chamber 4*b*, they are hard to deform.

By further inserting the flat conductor 3 toward the back side of the fitting chamber 4*b* after that while pushing down the engaging projections 8*a* of the elastic lock piece 8, the distal end part 3C of the flat conductor 3 comes into contact with the contact portions 5*d* of the terminals 5 from the upper side, pushes down the terminals 5, and goes over the contact parts 5*d*1. In this state, the flat conductor 3 is clamped by the contact parts 5*d*1 and the top part 4*h*, and is in conductive contact with the terminals 5.

Fall Preventing Structure for Flat Conductor

Figure 11A:
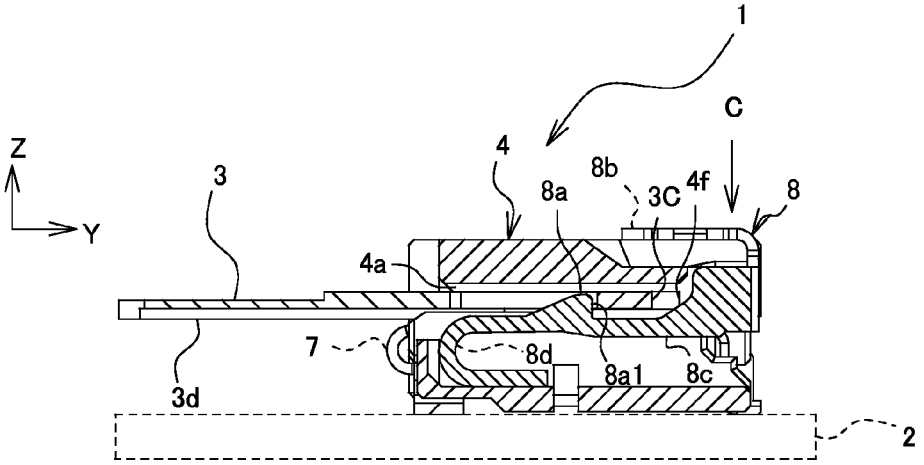
FIGS. 11A and 11B illustrate a state in which engaging projections of elastic lock pieces are engaged with the flat conductor.
Figure 11B:
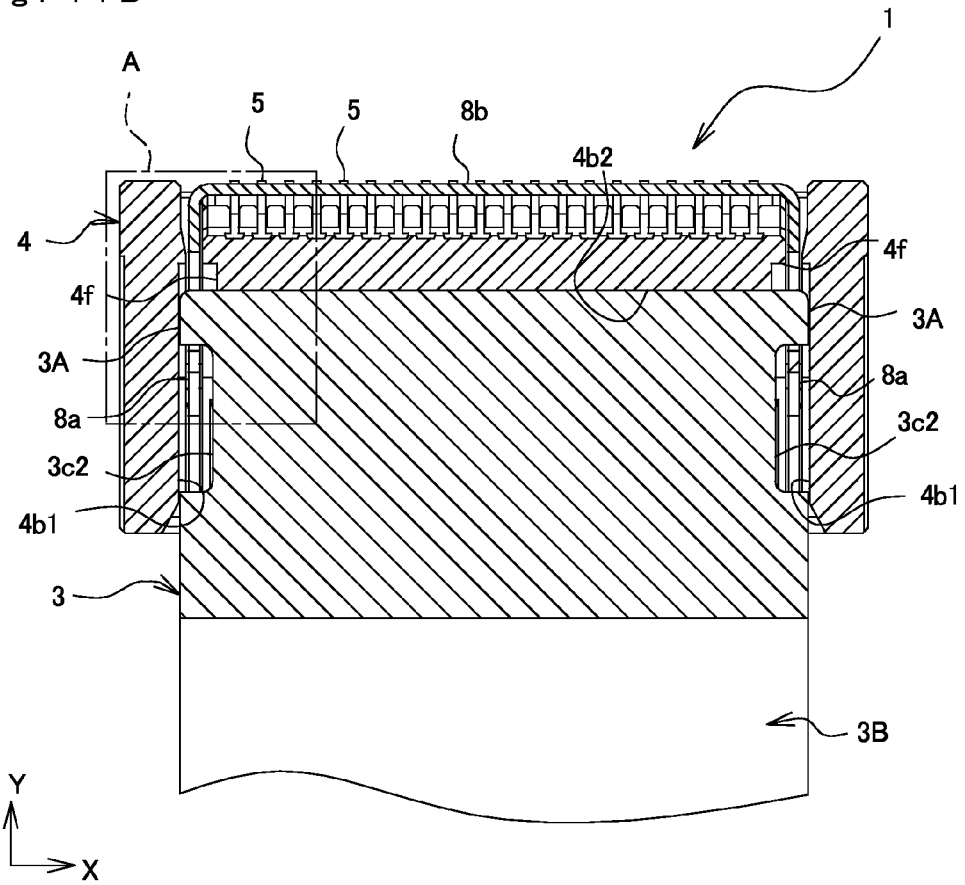

When the flat conductor 3 is inserted to the back side of the fitting chamber 4*b*, as described above, the engaging recesses 3*c* of the flat conductor 3 soon reach a position just above the engaging projections 8*a* of the elastic lock pieces 8. Then, the engaging projections 8*a* of the elastic lock piece 8 elastically displaced downward are displaced upward by the restoring force, and enter the engaging recesses 3*c* from below. At this time, the abutting edges 8*a*1 provided in the engaging projections 8*a* of the elastic lock piece 8 are located along the height direction Z. The abutting edges 8*a*1 abut on and engage with the engaging edge portions 3*c*1 of the engaging recess 3*c*, so that the connector 1 is locked (FIGS. 11A and 11B).

In this way, the elastic lock piece 8 retains the flat conductor 3 so that the flat conductor 3 does not fall off the connector 1, and this can enhance connection reliability between the connector 1 and the flat conductor 3.

When force in the removing direction is applied to the flat conductor 3 in a state in which the flat conductor 3 is locked in the connector 1, the engaging projections 8*a* of the elastic lock piece 8 abut on the engaging edge portions 3*c*1 of the engaging recess 3*c* in the flat conductor 3 so as to prevent the flat conductor 3 from falling off.

In this way, according to the connector 1 of the embodiment, since the flat conductor 3 can be locked in the connector 1 without providing other members such as an actuator and a slider, the size of the connector 1 can be reduced. Further, since the flat conductor 3 is not fitted along a member having a movable structure that may rattle, such as an actuator or a slider, but is fitted along the surfaces of the inner walls 4*b*1 of the fitting chamber 4*b* in the housing 4 itself, the reliable fitting state can be maintained with no unstable factor such as rattling. Further, since the lock can be achieved only one operation of inserting the flat conductor 3 into the connector 1, the fitting operation is easy.

Method for Removing Flat Conductor

The elastic lock piece 8 has the operating portion 8*b* provided on the upper side of the housing 4, and can be operated from the outside of the housing 4. This operation makes it easy to remove the flat conductor 3 from the housing 4 after separating the engaging projections 8*a* from the engaging recesses 3*c* of the flat conductor 3 to release the lock state.

This removing method will be specifically described below. When the operating portion 8*b* is pushed downward (in a direction of arrow C), the curved portions 8*d* of the elastic lock piece 8 elastically deform and the elastic arms 8*c* tilt obliquely. Thus, the engaging projections 8*a* are pushed down and come out of the engaging recesses 3*c* of the flat conductor 3. When the engaging edge portions 3*c*1 of the engaging recesses 3*c* thus separate from the abutting edges 8*a*1 of the engaging projections 8*a*, the flat conductor 3 is disengaged and the lock state is released. Hence, the flat conductor 3 can be removed from the connector 1.

When the operating portion 8*b* is pushed to enter the recess 4*h*1 of the housing 4, the engaging projections 8*a* can be sufficiently displaced downward and can be removed from the engaging recesses 3*c* of the flat conductor 3.

As described above, the flat conductor 3 can be prevented from falling off the connector 1 by inserting the engaging projections 8*a* in the engaging recesses 3*c* of the flat conductor 3 so that the engaging edge portions 3*c*1 abut on and engage with the abutting edges 8*a*1 in the removing direction of the flat conductor 3. Further, the elastic arms 8*c* are elastically displaced up and down in the height direction Z by operating the operating portion 8*b* so that the engaging projections 8*a* are inserted into and removed from the engaging recesses 3*c*. Hence, the abutting edges 8*a*1 can be easily engaged with and disengaged from the engaging edge portions 3*c*1 of the flat conductor 3.

Structure for Preventing Rupture of Flat Conductor

To remove the flat conductor 3 from the connector 1, it is necessary to remove the engaging projections 8*a* from the engaging recesses 3*c* of the flat conductor 3 by pushing the operating portion 8*b* downward and separating the abutting edges 8*a*1 of the engaging projections 8*a* from the engaging edge portions 3*c*1 of the engaging recesses 3*c*, as described above. However, the operator (not illustrated) sometimes makes a mistake in the operation procedure and pulls the flat conductor 3 without pushing down the operating portion 8*b* or without sufficiently pushing down the operating portion 8*b*.

It is assumed that the above-described escape spaces 4*f* are not provided and the back wall 4*b*2 provided in the widthwise direction X on the back side of the fitting chamber 4*b* abuts on both ends in the widthwise direction X of the distal end part 3C of the flat conductor 3 in the fitted state. The flat conductor 3 is further pulled in the removing direction from the state locked by the engaging projections 8*a*. Then, the body part 3B of the flat conductor 3 moves in the removing direction. However, since the engaging edge portions 3*c*1 are caught by the engaging projections 8*a*, the projection piece parts 3A do not follow the body part 3B of the flat conductor 3, but are left between the engaging projections 8*a* and the back wall 4*b*2.

When the flat conductor 3 is further pulled in the removing direction from this state, reactive force to the force of contact and engagement of the engaging edge portions 3*c*1 with the engaging projections 8*a* is concentrated and applied to roots 3A1 of the projecting piece parts 3A by the pull in the removing direction. Since the back wall 4*b*2 of the fitting chamber 4*b* abuts on the distal end part 3C of the flat conductor 3 in the fitted state and there is no space between the projecting piece parts 3A and the back wall 4*b*2, as described above, the projecting piece parts 3A cannot move and deform to avoid engagement of the engaging projections 8*a*. Since the projecting piece parts 3A cannot come out from between the engaging projections 8*a* and the back wall 4*b*2 of the fitting chamber 4*b*, excessive force is applied to the roots 3A1 of the projecting piece parts 3A, and this sometimes causes rupture. As a result, only the body part 3B of the flat conductor 3 except for the projecting piece parts 3A is pulled out of the fitting chamber 4*b*, and the projecting piece parts 3A are left inside the fitting chamber 4*b*. In this case, the conductive contact between the flat conductor 3 and the terminals 5 is hindered by fragments of the flat conductor 3, and this may reduce connection reliability. Hence, it is necessary to prevent such rupture.

In contrast, in this embodiment, the fitting chamber 4*b* has, at the positions opposed to the distal ends of the projecting piece parts 3A, the escape spaces 4*f* (FIGS. 13 and 14) to receive the projecting piece parts 3A that abut on the engaging projections 8*a* and are deformed in the inserting direction by pulling the flat conductor 3 in the removing direction. In this case, when the flat conductor 3 is strongly pulled in the removing direction in the lock state, as described above, the projecting piece parts 3A can deform in the inserting direction. This is because the fitting chamber 4*b* has the escape spaces 4*f* that can receive the deformed projecting piece parts 3A. Specifically, when the engaging edge portions 3*c*1 abut on the engaging projections 8*a*, the projecting piece parts 3A attempt to stay at the positions closer to the back side than the engaging projections 8*a* in the fitting chamber 4*b*. When the body part 3B of the flat conductor 3 is further pulled in the removing direction in that state, load is applied from the engaging projections 8*a* to the projecting piece parts 3A. As a result, the projecting piece parts 3A deform in a state connected at the roots 3A1 to the body part 3B so that the distal ends thereof are directed in the inserting direction.

Further, in the embodiment, the projecting piece parts 3A are provided at the opposite ends of the conductive wire 3*a* in the widthwise direction X of the flat conductor 3. Since the insulating layers 3*b* formed by insulating coating are softer than the conductive wire 3*a* formed of a conductive metal, the projecting piece parts 3A are easy to deform. When the projecting piece parts 3A deform, the engaging edge portions 3*c*1 tilt with respect to the removing direction, and corner parts 3A2 of the flat conductor 3 protrude frontward from the distal end part 3C of the flat conductor 3 in the fitted state. In this way, the corner parts 3A2 can enter the escape spaces 4*f*.

Figure 13A:
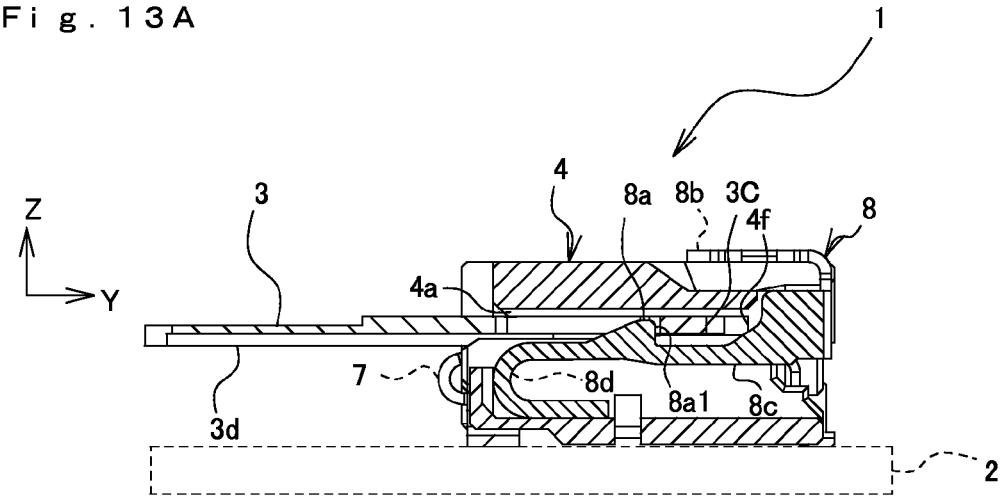
FIGS. 13A and 13B illustrate a state in which projecting piece parts of the flat conductor are deformed.
Figure 13B:
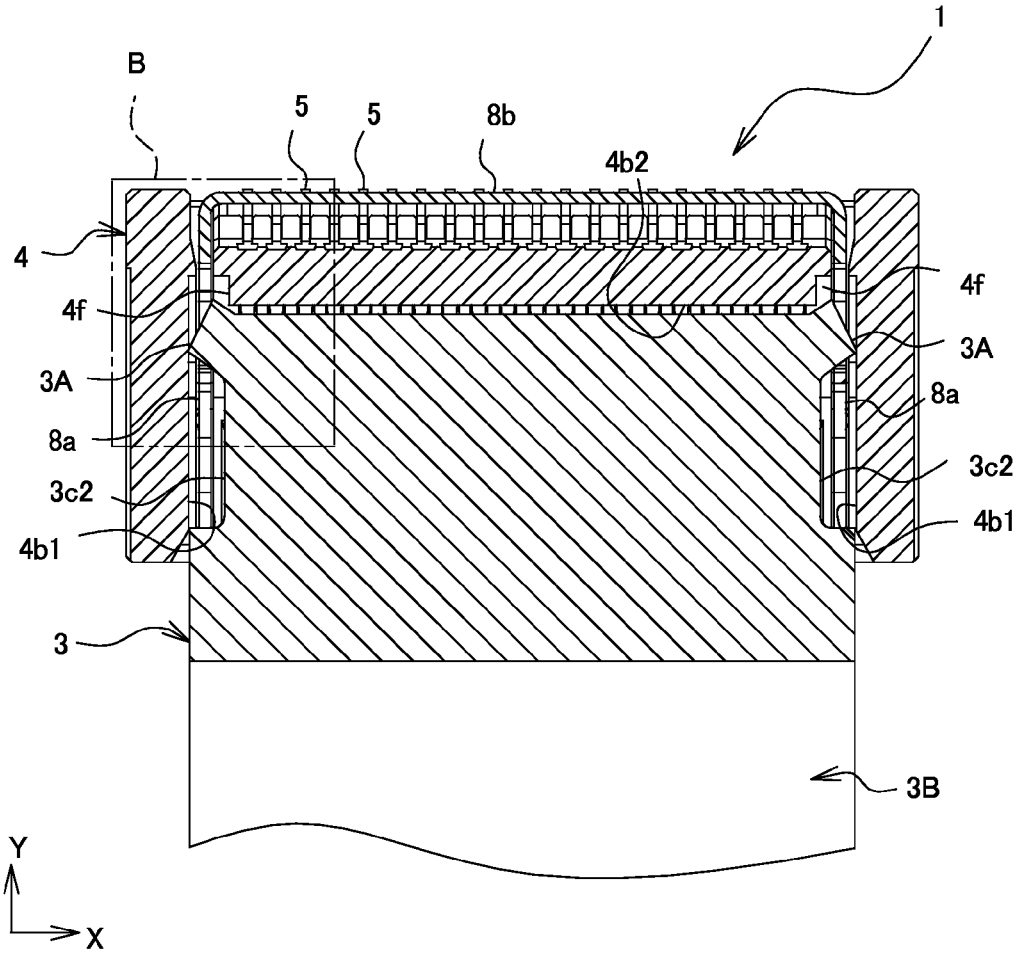
Figure 14:
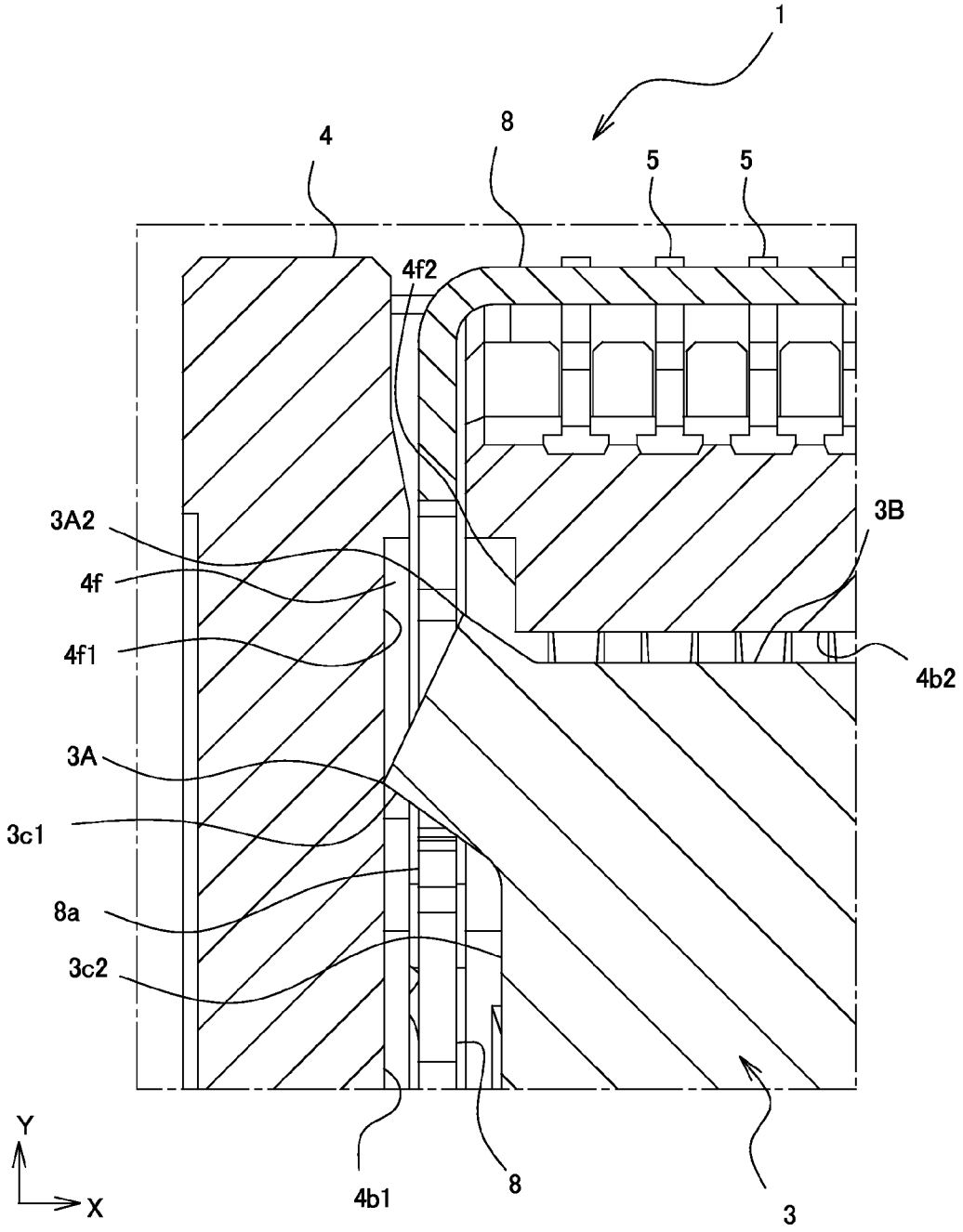
FIG. 14 is an enlarged partial cross-sectional view of a section of arrow B in FIG. 13B.

The projecting piece parts 3A can be deformed by the load from the engaging projections 8*a* to turn from the roots 3A1 (FIGS. 13A, 13B, and 14). Such deformation allows the projecting piece parts 3A to deform to avoid engagement of the engaging projections 8*a* and move in the removing direction while following the body part 3B of the flat conductor 3. From the above, excessive load is unlikely to be applied to the roots 3A1 of the projecting piece parts 3A, and the flat conductor 3 can be removed from the connector 1 without causing rupture.

In this way, even if the flat conductor 3 is inadvertently removed from the connector 1 without releasing the lock of the elastic lock piece 8 or without sufficiently releasing the lock, rupture of the projecting piece parts 3A can be suppressed.

The first side wall portions 4*f*1 are formed by extending the inner walls 4*b*1 of the fitting chamber 4*b* provided in the front-rear direction Y. In contrast, the second side wall portions 4*f*2 are provided closer to the center in the widthwise direction X than the engaging projections 8*a* of the elastic lock piece 8, and are provided even closer to the center in the widthwise direction X than the inner edge portions 3*c*2 of the engaging recesses 3*c* of the flat conductor 3 in the fitted state.

Figure 12:
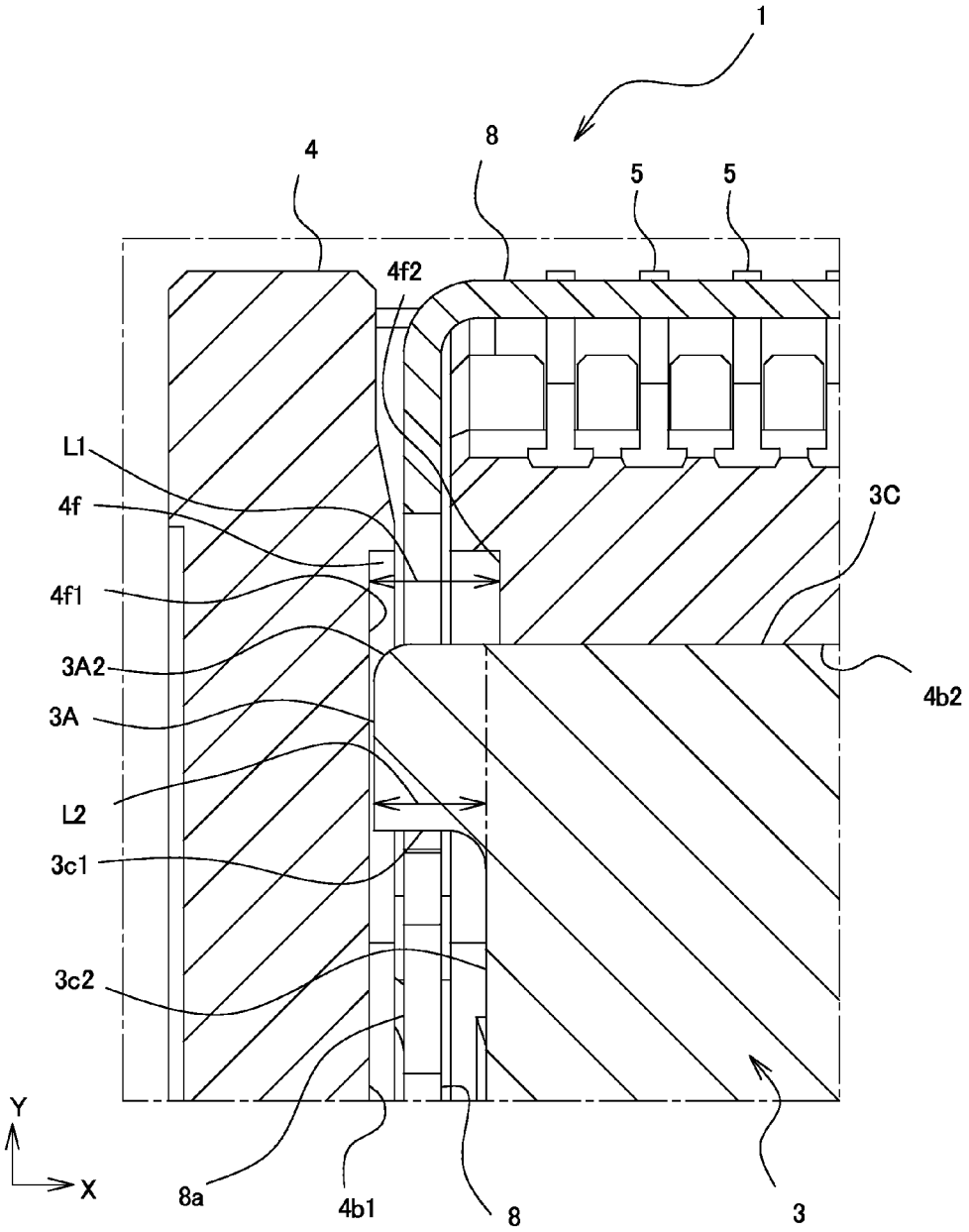
FIG. 12 is an enlarged partial cross-sectional view of a section of arrow A in FIG. 11B.

Thus, the distance between the first side wall portions 4*f*1 and the second side wall portions 4*f*2, that is, a length L1 in the widthwise direction X of the escape spaces 4*f* is more than a length (protrusion amount) L2 in the widthwise direction of the projecting piece parts 3A (FIG. 12). Hence, portions of the distal end part 3C of the flat conductor 3 on the side of the projecting piece parts 3A and in contact with the back wall 4*b*2 are reduced. Therefore, portions of the projecting piece parts 3A restricted by the back wall 4*b*2 from deforming are reduced, and the projecting piece parts 3A can more easily deform. Further, since the escape spaces 4*f* can be made wider, the deformed projecting piece parts 3A escape (are received) more. This can further suppress rupture of the roots 3A1 of the projecting piece parts 3A.

As described above, according to the connector 1 of the embodiment, even if the flat conductor 3 is removed from the connector 1 without releasing the lock of the elastic lock piece 8, rupture of the projecting piece parts 3A of the flat conductor 3 can be suppressed.

Modifications

In the above-described embodiment, the height is reduced by making the length of the escape spaces 4*f* in the height direction Z substantially equal to the length of the flat conductor 3 in the plate thickness direction. Alternatively, spaces may be formed on the upper and lower sides of the flat conductor 3 by making the length of the escape spaces 4*f* in the height direction Z more than the length of the flat conductor 3 in the plate thickness direction. In this case, the projecting piece parts 3A are bent upward and downward by utilizing the upper and lower spaces. This allows the projecting piece parts 3A to easily avoid the engaging projections 8*a*. Further, even if the deformed projecting piece parts 3A crease and become uneven in the height direction Z, the unevenness can be allowed by the spaces.

In the above-described embodiment, the engaging projections 8*a* can be firmly engaged with the engaging edge portions 3*c*1 to enhance the fall prevention effect by making the plate width of the engaging projections 8*a* less than the length of the engaging edge portions 3*c*1 of the flat conductor 3 in the plate width direction of the flat conductor 3. In contrast, for example, when the length of the engaging edge portions 3*c*1 is made substantially equal to the plate thickness of the engaging projections 8*a*, the engaging projections 8*a* are easily separated and removed from the engaging edge portions 3*c*1 when the flat conductor 3 is pulled in the lock state. This can suppress rupture of the projecting piece parts 3A.

In the above-described embodiment, the length L1 of the escape spaces 4*f* in the widthwise direction X is more than the length (protrusion amount) L2 of the projecting piece parts 3A in the widthwise direction. Alternatively, the length L1 and the length L2 may be equal, or conversely, the length L1 may be less than the length L2. This makes adjustment so that the projecting piece parts 3A are harder to deform. The flat conductor 3 can also become harder to be removed from the connector 1 when pulled by weak force.

What is claimed is:

1. A connector comprising:

a flat conductor;

a terminal in conductive contact with the flat conductor;

a housing having an insertion port for the flat conductor and a fitting chamber where the flat conductor and the terminal are in conductive contact with each other; and a lock part with which the flat conductor engages in a removing direction inside the fitting chamber, wherein the flat conductor includes an engaging recess provided in a side edge portion along an inserting direction into the fitting chamber and having an engaging edge portion configured to abut on and engage with the lock part in the removing direction, and a projecting piece part located between the engaging edge portion and a distal end part of the flat conductor, wherein the lock part is displaced in a thickness direction of the flat conductor to enter the engaging recess, and wherein the fitting chamber includes an inner wall provided along the inserting direction to guide the side edge portion of the flat conductor along an insertion length, a back wall configured to abut on the distal end part of the flat conductor, and an escape space provided at a position opposed to a distal end of the projecting piece part on a side of the back wall and configured to receive the projecting piece part that abuts on the lock part and is deformed in the inserting direction by pulling the flat conductor in the removing direction.

2. The connector according to claim 1, wherein a length of the escape space in a widthwise direction of the flat conductor in a fitted state is more than or equal to a length of the projecting piece part in the widthwise direction.

3. A connector that is conductively connected to a flat conductor serving as a connecting object, the connector comprising:

a terminal in conductive contact with the flat conductor;

a housing having an insertion port for the flat conductor and a fitting chamber where the flat conductor and the terminal are in conductive contact with each other; and a lock part with which the flat conductor engages in a removing direction inside the fitting chamber, wherein the flat conductor includes an engaging recess provided in a side edge portion along an inserting direction into the fitting chamber and having an engaging edge portion configured to abut on and engage with the lock part in the removing direction, and a projecting piece part located between the engaging edge portion and a distal end part of the flat conductor, wherein the lock part is displaced in a thickness direction of the flat conductor to enter the engaging recess, and wherein the fitting chamber includes an inner wall provided along the inserting direction to guide the side edge portion of the flat conductor along an insertion length, a back wall configured to abut on the distal end part of the flat conductor, and an escape space provided at a position opposed to a distal end of the projecting piece part on a side of the back wall and configured to receive the projecting piece part that abuts on the lock part and is deformed in the inserting direction by pulling the flat conductor in the removing direction.

4. The connector according to claim 3, wherein a length of the escape space in a widthwise direction of the flat conductor in a fitted state is more than or equal to a length of the projecting piece part in the widthwise direction.

* * * * *